US005836576A

United States Patent [19]

Ebner et al.

[11] Patent Number: 5,836,576

[45] Date of Patent: Nov. 17, 1998

[54] APPARATUS FOR REMOVING COPIES AND/OR DOCUMENTS FROM A MACHINE

[75] Inventors: Felix Ebner; Ulrich Fischer; Gerhard Glemser; Peter Herbster; Juergen Ries; Helmut Stohrer, all of Stuttgart, Germany

[73] Assignee: Eastman Kodak Company, Rochester, N.Y.

[21] Appl. No.: 731,037

[22] Filed: Oct. 8, 1996

[30] Foreign Application Priority Data

Oct. 13, 1995 [DE] Germany ..... 195 38 065.7

[51] Int. Cl.[6] ..... B65H 31/30

[52] U.S. Cl. ..... 270/58.02; 270/58.2; 232/43.3; 414/790.3

[58] Field of Search ..... 270/58.01, 58.02, 270/58.19, 58.2, 58.26; 232/1 R, 43.3; 414/789.9, 790.3

[56] References Cited

U.S. PATENT DOCUMENTS 4,942,535 7/1990 Francisco ..... 364/478
5,108,082 4/1992 Shea et al. ..... 270/47
5,245,547 9/1993 Ramsey ..... 364/478
5,279,218 1/1994 Oshio et al. ..... 101/2
5,697,761 12/1997 Morgan et al. ..... 414/790.3

*Primary Examiner*—David A. Okonsky
*Attorney, Agent, or Firm*—Lawrence P. Kessler

[57] ABSTRACT

An apparatus for removing copies and/or documents from a machine has a catch and removal tray (2) which can be extended telescopically out of the machine (1). The catch and removal tray (2) consists of a fixed section (3) inside the machine (1) and a movable section (4) which can be drawn out of the machine (1). The fixed section of the tray (3) acts as a catch tray for documents processed by the machine (1) and has a drive mechanism (6, 7, 19) which drives a sliding panel (5) which extends downwards into the fixed section of the tray (3) and which pushes the stack of documents (8) from the fixed section of the tray (3) into the extended movable section of the tray (4). The fixed section of the tray (3) has a photoelectric cell (20) which activates the sliding panel (5) when the stack of documents reaches the maximum height. Another sensor detects whether the movable section of the tray (4) is in the extended position and whether or not it is empty and sends an appropriate signal to a control unit which only sets the sliding panel (5) in motion when the movable section of the tray (4) is in the extended position and is empty.

11 Claims, 5 Drawing Sheets

APPARATUS FOR REMOVING COPIES AND/OR DOCUMENTS FROM A MACHINE

BACKGROUND OF THE INVENTION

The invention relates to an apparatus for removing copies and/or documents from a machine, especially a machine for collating and folding and/or binding into documents copies received from by a copier, the said apparatus having a catch and removal tray which is movable drawer fashion from a first position inside the machine in which it acts as a catch tray for copies or documents to a second position in which it extends outwards from the machine thus allowing the copies and/or documents to be removed.

U.S. Pat. No. 5,108,082 describes a finisher for collating single copies received from a copier into stapled, unstapled or knife-folded documents. The finished documents from the knife folder fall into a catch and removal tray which resembles a drawer and is pulled out of the machine by hand when it is full to capacity so that the documents can be manually removed. Especially in situations where multi-page documents are being produced which after passing through the folding rollers compress less tightly along the fold the more pages they contain, the catch and removal tray is filled relatively quickly so that the document production process has to be continually interrupted in order to empty the catch tray and then return it to its document catcher position.

SUMMARY OF THE INVENTION

It is the object of the present invention to create a catch and removal tray such that it provides a greater document capacity and enables continuous operation of the machine as well as offering a choice between normal and expanded document capacity.

In accordance with the invention, this object is attained in that:

- the catch and removal tray can be extended telescopically outwards from the machine and has a fixed and a movable tray section;
- the fixed sections of the tray is located inside the machine and acts as a catch tray for copies and/or documents placed more or less flat on top of one another;
- the movable section of the tray acts as a removal tray for the copies and/or document when drawn outwards from the machine to its extended position;
- in lateral cross-section, at right angles to the direction of movement of the movable section of the tray, the two sections of the tray are essentially identical being "U" shaped with an open top and each having an essentially horizontal bottom panel and vertical side panels running parallel to the direction of movement of the movable section of the tray;
- the movable section of the tray runs parallel to the slides underneath the fixed section of the tray thus enveloping it, and;
- a sliding panel which is movable in the same direction as the direction of movement of the extending section of the tray extends downwards into the fixed section of the tray and can be moved from an initial backward position outside the storage area of the tray to a forward position in which it pushes the copies and/or documents in the tray into the movable, extended section of the tray.

Furthermore, the present invention achieves the above purpose by virtue of a method by which documents can be placed in and removed from a telelscopically extendible catch and removal tray capable of being drawn out drawer fashion from a machine and having a fixed and a movable section, the copies and/or documents being stacked in the fixed section of the tray and the method comprising the following steps:

A. The movable section of the catch and removal tray is drawn out of the machine to the extended position before commencement of the document stacking process.
   - A.1 The copies and/or documents are stacked in the tray until they reach a maximum stack height detected by a sensing device.
   - A.2 When the stack reaches the maximum height the copies and/or documents are automatically pushed by the sliding panel into the extended section of the tray where they enter the detection range of a document sensor. The sliding panel returns to its initial position.
   - A.3 More copies and/or documents are stacked in the rear section of the tray until the stack reaches the maximum height again. The new stack of copies and/or documents is automatically pushed out into the extended section of the tray if the document sensor for that section of the tray indicates that it is empty. If the document sensor detects that there is still a stack of documents in the extended section of the tray, the sliding panel is not set in motion until that stack has been removed.

B. The movable section of the catch and removal tray remains inside the machine during the document stacking process.
   - B.1 The copies and/or documents are stacked in the tray until they reach a maximum stack height detected by a sensor at which point the stacking process is paused.
   - B.2 The movable section of the tray is drawn out of the machine. When drawn out to its fully extended position, the movable section of the tray actuates a switch which activates the sliding panel which then pushes the stack of copies and/or documents into the extended section of the tray.

Advantageously, the bottoms of the two tray sections have sloping panels joining the horizontal bottom panel with the vertical side panels so that the documents placed in the tray will come to rest in a curled position which prevents the document from unfolding to the same degree and therefore saves space.

In a further modification of the invention, the horizontal bottom panel of the catch tray also has a raised section running at least the length of the travel of the sliding panel and over which the lower front face of the sliding panel passes in such a way that documents lying on that raised section of the tray bottom panel cannot become jammed between the sliding panel and the bottom of the catch tray.

In yet another modification of the invention, a U-shaped guide is provided above the catch tray which guides by one edge a document processed by the machine and destined for the catch tray to a point above the horizontal bottom panel of the tray where it slides out of the guide and falls under its own weight into the catch tray in a more or less flat position.

The effectiveness of the design provides double the storage capacity of a conventional tray simply by the tray being pulled out to the extended position. If the stack of documents in the extended section of the tray is removed as intended this provides a highly effective means of maintaining a continuously high storage capacity without the necessity for interrupting the production process. Another particularly effective mode of operation for increasing the storage capacity can be effected if the stack of documents in the extended section of the tray is pushed by the next stack of documents out of the end of the tray, which for this particular purpose is open, and onto a conveyor belt or directly into a larger container.

In the event that only a small quantity of documents is produced and/or that the documents are very thin, in other words in cases where a relatively small storage capacity is sufficient, the effectiveness of the invention also allows the movable section of the tray to be left pushed in and to be emptied by being drawn out only as and when required without the necessity for any special action.

BRIEF DESCRIPTION OF THE DRAWINGS

Other features and advantages of the invention are detailed below in the description of an embodiment of the invention illustrated in the diagrams and in the claims. In schematic diagrams:

DETAILED DESCRIPTION OF THE INVENTION

The apparatus for removing copies and/or documents as described by the present invention is part of a finisher of which only those components necessary for an understanding of the apparatus are illustrated. A finisher of the type in question is described by U.S. Pat. No. 5,108,082 for example. The finisher, which will be referred to from now on simply as the machine, is identified by the reference number 1 in FIGS. 1, 2, and 5.

Figure 1:
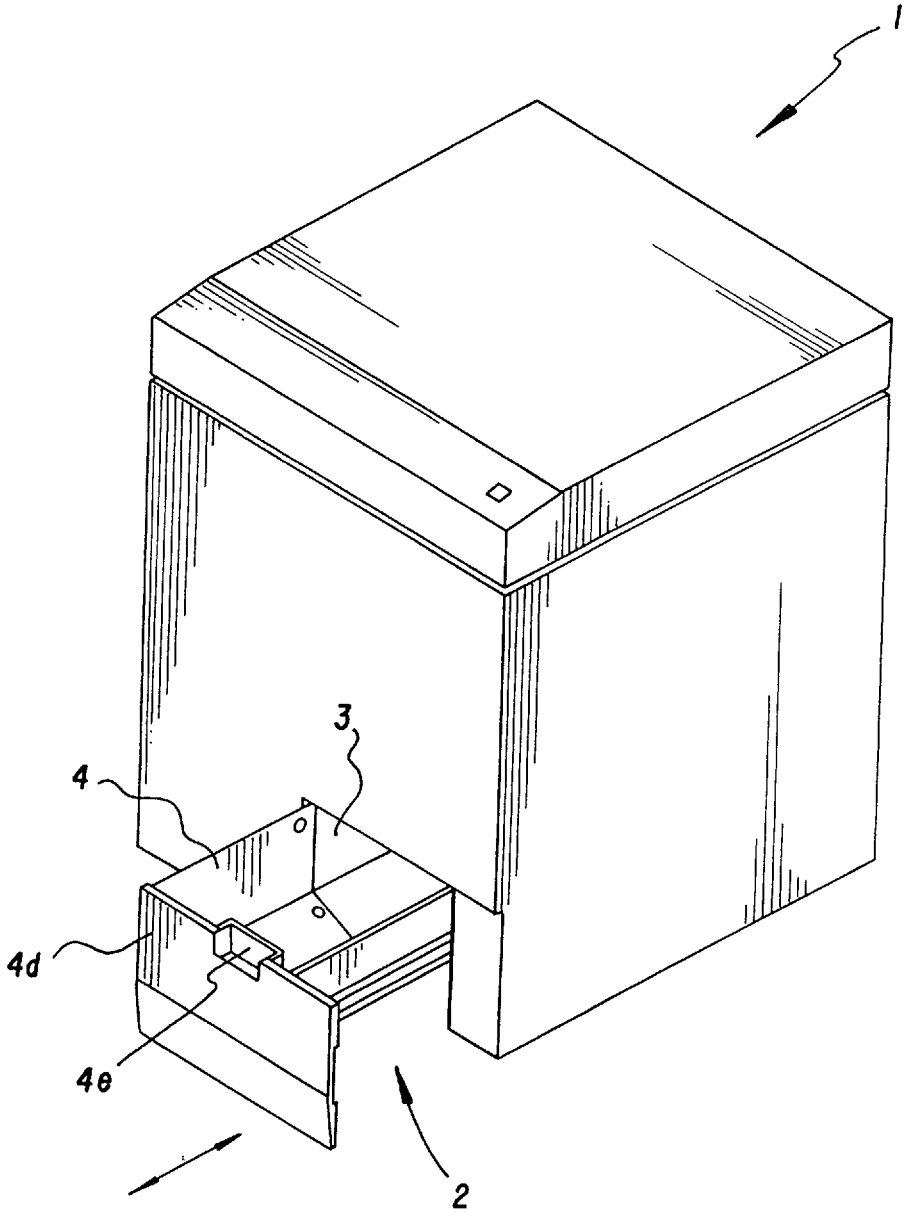
FIG. 1 shows the machine with the catch and removal tray with the movable section of the tray in the extended position.

As shown in FIG. 1 in particular, located in the lower part of the machine 1 is a catch and removal tray 2 which is accessible from the front of the machine and which has a fixed section 3 inside the machine 1 and a movable section 4 which can be drawn out of the machine 1. The front end of the movable section of the tray 4 is bounded by a front panel 4*d* which fits flush with the front panel of the machine when in its pushed in position (not illustrated). The front panel 4*d* incorporates a handle 4*e*.

Figure 2:
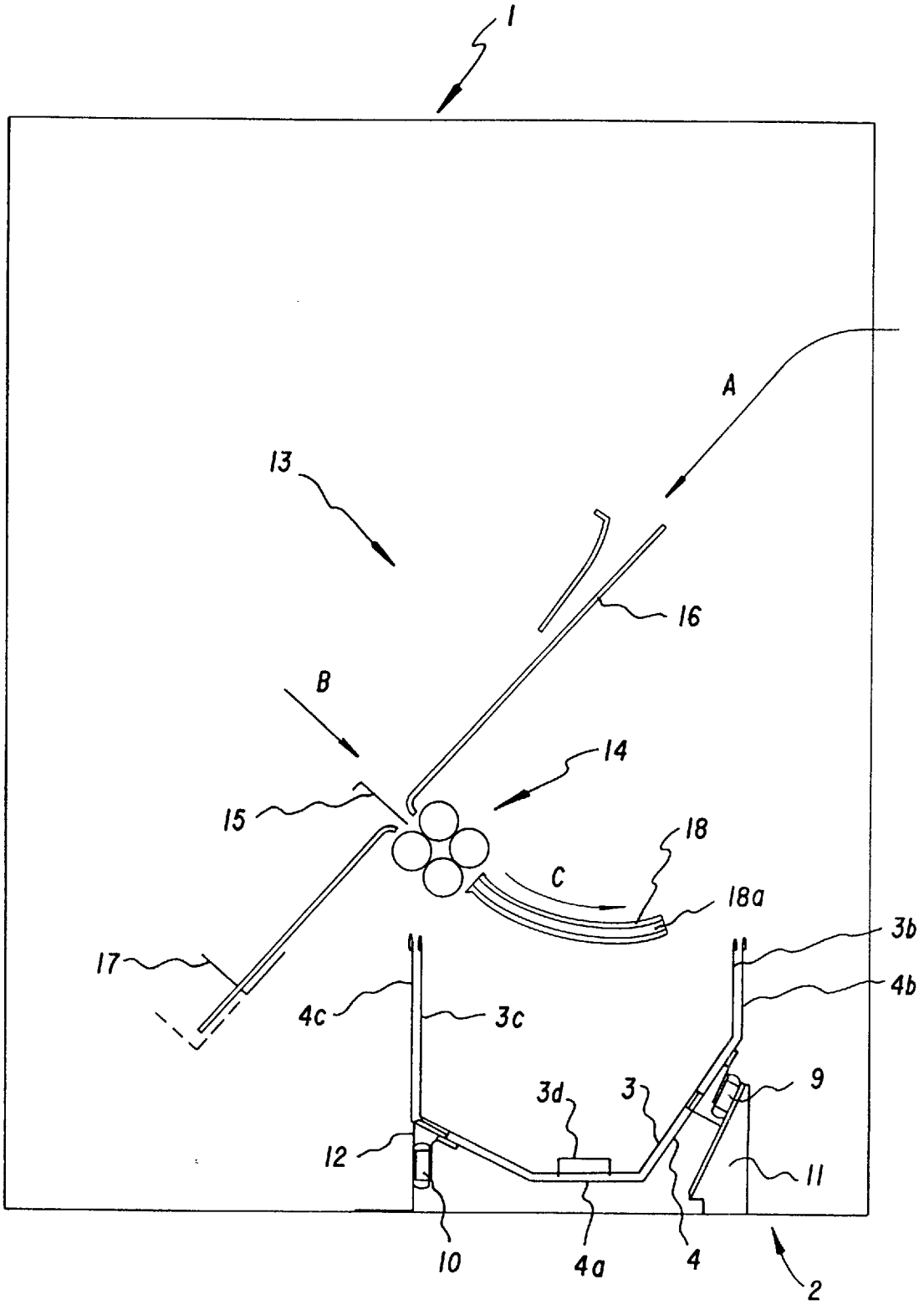
FIG. 2 shows the apparatus as per FIG. 1 in a cross-sectional, simplified view.
Figure 3:
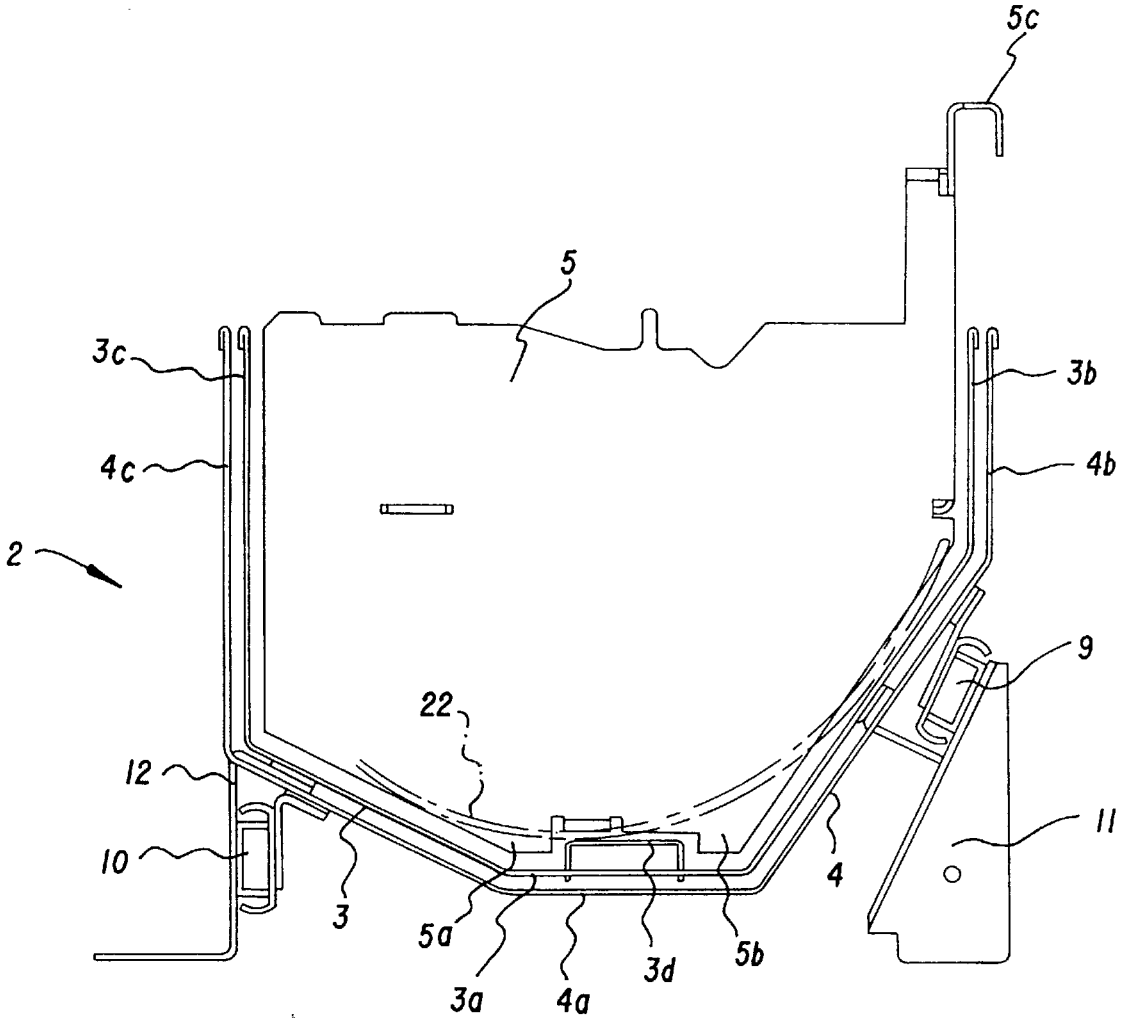
FIG. 3 shows a detail of the apparatus as per FIG. 2.

In the embodiment of the invention illustrated, the catch and removal tray 2 as per FIG. 2 is used to catch and remove finished documents received from a knife folder mechanism 13. Those documents may be multi-page, stapled and folded documents or documents consisting only of a single folded sheet. The fixed section of the tray 3 as illustrated in FIGS. 2 and 3 is fixed to the machine 1 by means of brackets 11 and 12. Attached to the brackets 11 and 12 are ball-bearing guides 9 and 10 of the conventional type to which the movable section of the tray 4 is attached and along which it runs.

As illustrated in FIGS. 2 and 3, both sections of the tray 3 and 4 have the same U-shaped cross-section with an essentially horizontal bottom panel 3*a* and 4*a* respectively and vertical side panels 3*b*, 3*c* and 4*b*, 4*c* respectively running parallel to the direction of movement of the extendible section of the tray 4. The width of the tray between the side panels 3*c* and 3*d* is at least as equal to the width of the largest document format for which the tray is intended. The movable section of the tray 4 runs parallel to and slides underneath the fixed section of the tray 3 and envelopes the fixed section of the tray 3 at a close clearance (see FIG. 3 in particular) but sufficient to allow free movement.

The horizontal bottom sections 3*a* and 4*a* of the tray sections 3 and 4 respectively have sloping panels visible in FIGS. 2 and 3 joining the more or less centrally positioned horizontal bottom panel to the vertical side panels 3*b*, 3*c* and 4*b*, 4*c* respectively. Shaping the bottoms 3*a* and 3*b* of the tray sections in this way ensures that the documents placed in the tray come to rest in a curled position which prevents them unfolding to the otherwise normal degree and therefore effectively increasing the storage capacity of the tray.

The horizontal bottom panel 3*a* of the fixed section of the tray 3 also has a raised section 3*d*. That raised section 3*d* is located approximately in the centre of the horizontal bottom panel 3*a*, runs parallel to the direction of movement of the extendible section of the tray 4 and is narrower than the horizontal bottom panel 3*a*. The purpose of the raised section 3d is explained below at the appropriate point.

Figure 4:
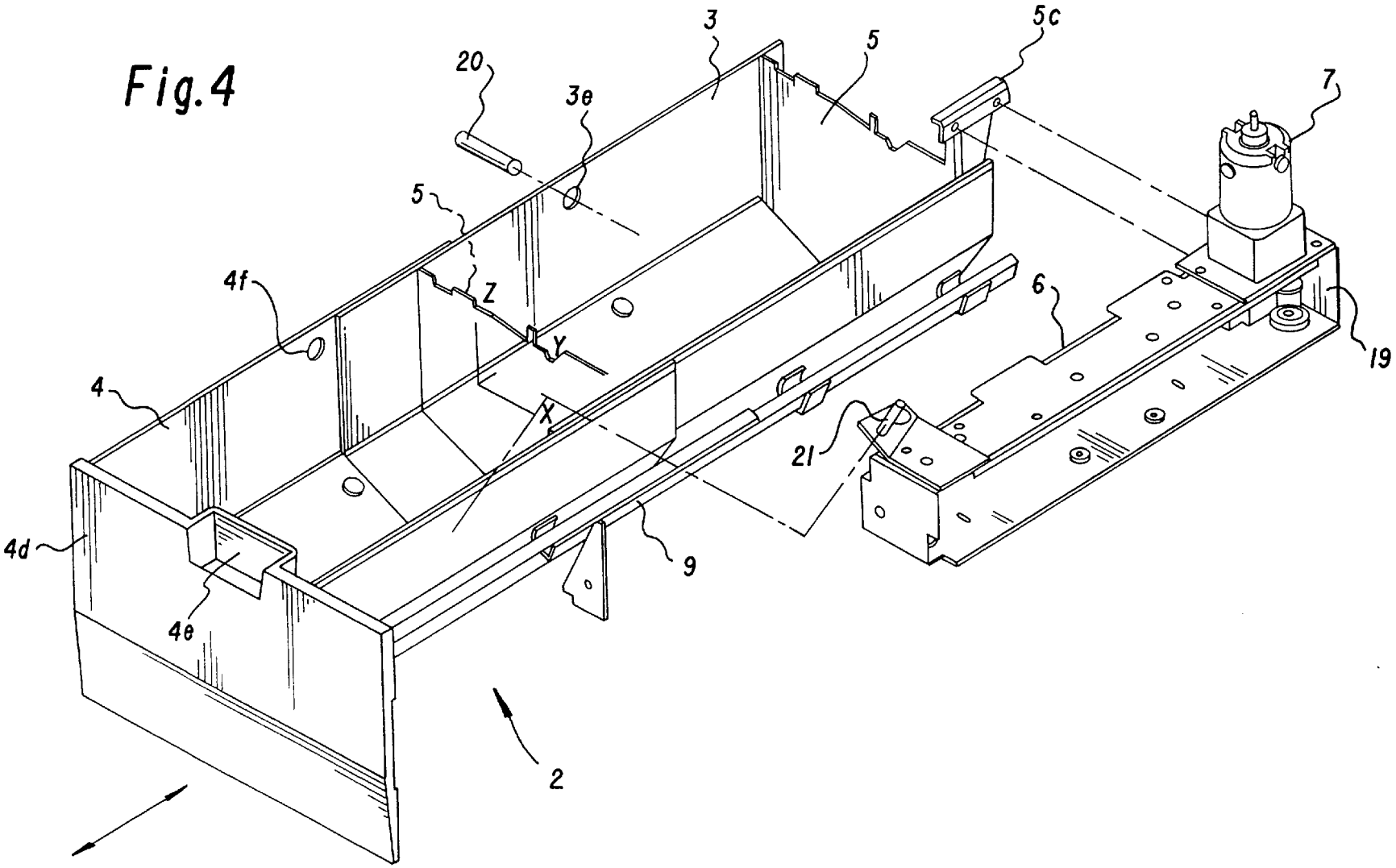
FIG. 4 shows a cutaway of the apparatus as per FIG. 1 in three-quarter view.

The apparatus has a sensing device which detects when the stack of documents in the fixed section of the tray 3 has reached the maximum height. That sensing device is of the conventional type and is represented in FIG. 4 in schematic form and might consist, for example, of a photoelectric cell 20 whose beam is directed through a hole 3*e* in the fixed section of the tray 3 into the document storage space. Another hole 4*f* in the movable section of the tray 4 allows the beam to pass through when the movable section of the tray 4 is pushed in.

Figure 5:
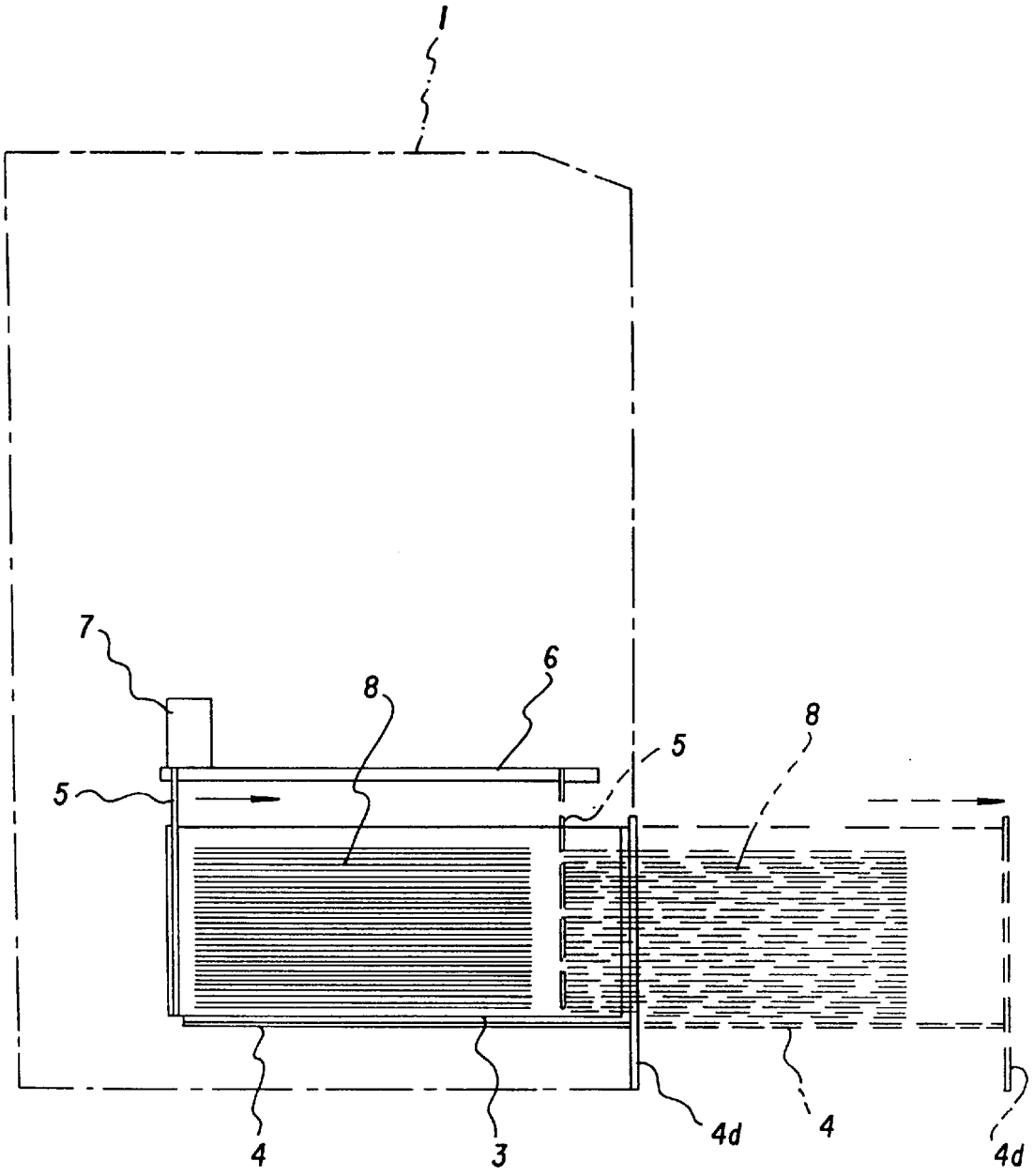
FIG. 5 shows the apparatus as per FIG. 1 in a simplified, cross-sectional side view showing only its basic arrangement.

Extending downwards into the fixed section of the tray 3 is a sliding panel 5 which can be moved in the same direction as the movable section of the tray 4 from an initial backward position outside the storage area of the tray (see FIGS. 4 and 5) to a forward position in which it pushes the documents 8 in the tray into the movable, extended section of the tray 4 (partially illustrated in FIG. 4 and represented in FIG. 5 by broken lines). The fixed section of the tray 3 extends beyond the initial backward position of the sliding panel 5 in such a way that the sliding panel 5 effectively forms a rear panel for the fixed section of the tray (see FIGS. 4 and 5) which prevents documents from falling inside the machine.

The outer edge of the sliding panel 5 extending downwards into the fixed section of the tray follows the inner contours of the side and bottom panels 3, 3*b*, 3*c* and 3*d* of the fixed section of tray 3. On its lower edge the sliding panel 5 has protrusions 5*a* and 5*b* (see FIG. 3) which extend downwards past the raised section 3*d* on the horizontal bottom panel 3*a* so that the documents lying on the raised section 3*d* cannot become jammed between the sliding panel 5 and the bottom panel 3*a* of the fixed section of the tray 3. To that end, the raised section 3*d* runs at least the fill length of the travel of the sliding panel 5 described in more detail below so that the documents can safely be pushed the full distance traveled by the sliding panel 5 out of the fixed section of the tray 3 without the risk of jamming.

FIG. 4 shows a drive system for the sliding panel 5 which consists essentially of a toothed drive belt 6, a motor 7 and the cog wheels (not illustrated) of the conventional type in which the drive belt 6 engages, the said drive system being mounted on a bracket 19. The drive system 6,7 and 9 which is positioned outside the storage area of the fixed section of the tray 3 is shown separated from the catch and removal tray 2 for the sake of clarity and the manner in which it locates against the tray is indicated by broken lines. The sliding panel 4 is attached to the toothed drive belt 6 by means of a bracket 5*c*. The cog wheels with which the drive belt 6 engages are mounted on the bracket 19 which is fixed to the machine housing 1 in such a way that they are able to rotate and one of the cog wheels is driven by the reversible motor 7. Attached to the bracket 19 there is also a sensor 21 which is directed at the bottom panel 4*a* of the movable section of the tray 4 as indicated by the broken line and serves as a means of determining whether or not the movable section of the tray 4 is empty. FIG. 2 illustrates the arrangement referred to above of the document catch and removal tray as defined by the present invention in conjunction with a knife folder mechanism 13 of the conventional type. The knife folder mechanism 13 is described only in general terms and to the extent required for an understanding of the invention.

The machine 1 receives single sheets, typically copies from a copier (not illustrated) of the conventional type, which enter in the direction indicated by arrow "A" into an input and processing unit 16. If only one sheet is to be bolded, it slides down to the stop 17 which is adjustable according to the position of the fold as determined by the paper format. Once aligned, the sheet is then pushed between the folding rollers 14 by a folding blade 15 moving in the direction of arrow "B" and the folding blade 15 is then withdrawn again in the opposite direction. The folding rollers 14, of which the first pair are the pre-folding rollers and the second pair the compression rollers, take hold of the sheet, fold it and convey the finished document in the direction indicated by arrow "C" into a guide 18 located above the storage area of the catch and removal tray 2.

The guide 18, which is adjustable in a lateral direction in relation to the plane of conveyance of the document in order to be able to accommodate different copy/document formats, has a U-shaped guide channel 18*a* into which one edge of the document id fed as it exits from the folding rollers 14. The guide 18 guides the document over the storage area of the fixed section of the tray 3 as long as some part of it is still between the folding rollers 14, while the upward curve of the guide 18 brings the document to a more or less horizontal position. Since the guide 18 only runs along one edge of the document, once the document is free of the folding rollers 14, it slides out of the guide channel 18*a* and falls under its own weight onto the bottom of the fixed section 3 of the catch and removal tray 2 where it lies in a more or less flat position.

If several sheets are to be stapled together and folded to form a multi-page document, then the individual sheets fed into the machine in the direction of arrow "A" first enter a stapling mechanism of the conventional type (not illustrated) positioned in front of the knife folder mechanism 13. There they are stacked together at a stop which is adjustable for different copy formats, stapled together and passed on to the knife folder mechanism 13 and folded as described above. The finished document then passes into the fixed section of the tray e as described above.

Due to the shape of the bottom of the fixed section of the tray 3, a document 22 lies in the tray in the manner illustrated in FIG. 3 by the broken lines.

The apparatus for removing copies and/or documents as described by the present invention is equipped with a control unit (not illustrated) having conventional means such as photoelectric cells 20 and 21 and switches (not illustrated) for detecting the position of the movable section of the tray 4 and the sliding panel which enable it to operate in the following modes.

First Mode of Operation

The movable section 4 of the catch and removal tray 2 is drawn out of the machine 1 to the extended position as shown in FIG. 1 (also indicated in FIG. 5 by the broken lines before commencement of the document stacking process. That position is signaled to the control unit by a switch located at a point on the path of the movable section of the tray 4 whereupon the control unit gives clearance for commencement of the document stacking process.

The documents are stacked in the fixed section of the tray 3 until the stack reaches the maximum height as detected by the photoelectric cell 20. When the stack reaches the maximum height, a signal from the photoelectric cell 20 automatically activates the drive system 6, 7 and 19 as a result of which the sliding panel 5 pushes the stack of documents 8 from the fixed section of the tray 3 into the extended movable section of the tray 4 (indicated in FIG. 5 by broken lines).

Having been pushed out into the extended section of the tray 4, the documents pass through the beam from the photoelectric cell 21 which then signals to the control unit that the extended section of the tray 4 is fill. The documents 8 are now in a position outside the machine 1 from where they can easily be removed from the tray by hand.

At the appropriate points on the path of the sliding panel 5 there are two switches (not illustrated) one of which marks the limit of forward travel and the other the limit of rearward travel. When the sliding panel 5 reaches the limit of forward travel, the switch in question activates retraction of the sliding panel 5 so that it immediately returns to its initial backward position. When the sliding panel reaches the limit of its rearward travel, the switch in question switches off the drive system 6, 7 and 19 for the sliding panel 5. Ideally, the drive system 6, 7 and 19 will be synchronized with the knife-folding mechanism 13 in such a way that the sliding panel 5 will have returned to its initial backward position by the time the next finished document drops into the tray so that the stacking process does not have to be interrupted.

The documents are once again stacked in the tray until the stack reaches the maximum height. When the forward stack of documents is removed, the photoelectric cell 21 sends a signal to that effect to the control unit so that the next stack of documents can automatically be pushed into the empty extended section of the tray 4.

If the photoelectric cell 21 detects the presence of a stack of documents 8 which has not been removed from the extended section of the tray 4, the sliding panel 5 is not set in motion and further production and stacking of documents is halted. Not until the forward stack of documents has been removed is the rear stack of documents moved forwards, the sliding panel then immediately returned to its initial backward position and the stacking process automatically restarted.

This mode of operation effectively achieves an increase in the machine's storage capacity. The sliding panel 5 is also only automatically activated when the stack reaches the maximum height so that the maximum storage capacity is always utilized. If the stack of documents 8 in the extended section of the tray is removed as intended this also enables continuous production of documents without interruption.

Another mode of operation which increases the storage capacity can be effected if, in contrast to the first mode of operation described above, the stack of documents in the extended section of the tray 4 is immediately pushed by the next stack of documents out of the end of the extended section of the tray 4, which for this particular mode of operation is open (front panel 4*d* removed and photoelectric cell 21 not used). The stack of documents thus pushed out of the open end of the extended section of the tray 4 passes onto a conveyor belt (not illustrated) or falls directly into a larger container (not illustrated). Due to the fact that the forward stack documents 8 in the extended section of the tray 4 does not have to be removed by hand, a high effective storage capacity and uninterrupted production of documents can be obtained.

Second Mode of Operation

The movable section 4 of the catch and removal tray 2 remains inside the machine 1 during the document stacking process, its position being signaled to the control unit by the rear switch located on the path of the movable section of the tray 4. The finished documents are stacked in the fixed section of the tray 3. When the stack of documents reaches the maximum height as detected by the photoelectric cell 20, further production and stacking of documents is halted.

In order that the stack of documents can be removed, the movable section of the tray 4 is drawn outwards from the machine 1. When movable section of the tray 4 is at its fully extended position this is signaled to the control unit by a forward switch located on the path of the movable section of the tray 4 as a result of which the drive system 6, 7 and 19 is activated and the sliding panel 5 pushes the stack of documents 8 from the fixed section of the tray 3 into the extended section of the tray 4 (indicated in FIG. 5 by broken lines).

When the sliding panel 5 reaches the limit of forward movement, the switch which marks that position is actuated, thereby activating retraction of the sliding panel 15 so that it immediately returns to its initial backward position.

The documents 8 are now in a position outside the machine 1 from where they can easily be removed from the tray by hand.

The next stacking process can not begin until the movable section of the tray 4 is pushed back into the machine 1 thus actuating a switch positioned in its path and thereby resetting the control unit to its initial status.

The second mode of operation can be put to effective use if only a small number of documents is being produced and/or if the documents are very thin so that the capacity of the fixed section of the tray 3 is sufficient on its own.

The apparatus is also fitted with a removal button (not illustrated) linked to the first mode of operation. That removal button is linked to the control unit in such a way that if it is pressed when the movable section of the tray 4 is extended, the drive system 6, 7 and 19 is activated so that the stack of documents is pushed forwards by the sliding panel 5 without the photoelectric cell 20 which detects the maximum stack height having given the control signal otherwise required for activation of the sliding panel. The control unit consists of a computer of the conventional type (CPU) which after receiving the removal button signal calculates a time window within which the sliding panel can be moved without the document production/stacking process having to be interrupted. The removal button can be used at any point in the production process to activate ejection of any size of document stack including, for example, a final stack at the end of a production run which does not reach the maximum stack height determined by the photoelectric cell 20.

In addition to its use in conjunction with a stapling and knife-folding mechanism as illustrated in the embodiment described by the present invention can, for example, also be used for documents bound by gluing or for stacks of single sheets (not illustrated).

The present invention was described with reference to a preferred embodiment, but modifications can of course be made by one skilled in the art, without departing the scope of the claims which follow.

We claim:

1. Apparatus for removing copies and/or documents from a machine and in particular machine for collating and folding and/or binding into documents copies received from a copier, the said apparatus having a catch and removal tray which is movable drawer fashion from a first position inside the machine in which it acts as a catch tray for copies or documents to a second position in which it extends outwards from the machine thus allowing the copies and/or documents to be removed characterized in that:

said catch and removal tray (2) can be extended telescopically outwards from said machine (1) and has a fixed (3) and a movable (4) tray section;

said fixed section of the tray (3) is located inside said machine (1) and acts as a catch tray for copies and/or documents (8) placed more or less flat on top of one another;

said movable section of the tray (4) acts as a removal tray for the copies and/or documents (8) when drawn outwards from said machine (1) to its extended position;

in lateral cross-section, at right angles to the direction of movement of the movable section of said tray (4), said two sections of said tray (3; 4) are essentially identical being "U" shaped with an open top and each having an essentially horizontal bottom panel (3*a*, 4*a*) and vertical side panels (3*b*, 3*c*; 4*b*, 4*c*) running parallel to the direction of movement of said movable section of the tray (4);

said movable section of the tray (4) runs parallel to and slides underneath said fixed section of the tray (3) thus enveloping it, and;

a sliding panel (5) which is movable in the same direction as the direction of movement of said extending section of said tray (4) extends downwards into said fixed section of the tray (3) and can be moved from an initial backward position outside said storage area of the tray to a forward position (8) in said tray into the movable, extended section of said tray (4).

2. Copy and/or document removing apparatus in accordance with claim 1, characterized in that said bottom panels (3*a*; 4*a*) of said two sections (5; 4) of said catch and removal tray (2) consist of a more or less centrally positioned, horizontal bottom panel and two sloping bottom panels joining said horizontal bottom panel to said vertical side panels (3*b*, 3*c*; 4*b*, 4*c*).

3. Copy and/or document removing apparatus in accordance with claim 2, characterized in that said horizontal bottom panel of said fixed section of the tray (3) has a raised section (3*d*) running parallel to said bottom panel (3*a*) and the direction of movement of said sliding panel (5) and extending at least the length of the travel of said sliding panel (5) and positioned more or less centrally on said bottom panel (3*a*) and which is narrower that said horizontal bottom panel (2*a*).

4. Copy and/or document removing apparatus in accordance with claim 3, characterized in that the outer edge of said sliding panel (5) extending downwards into the fixed section of said tray (3) follows the inner contours of said side and bottom panels (3, 3*b*, 3*c*, 3*d*) of said fixed section of said tray (3) and on its lower edge said sliding panel (5) has protrusions (5*a*, 5*b*) which extend downwards past said raised section (5) on the horizontal bottom panel (3*a*) so that the bottom edge of said sliding panel (5) is below the top of said raised section (5*d*).

5. Copy and/or document removing apparatus in accordance with claim 4, characterized in that said sliding panel (5) is attached to a toothed drive belt (6) by a bracket (5*c*) and that said toothed drive belt (6) is driven by a motor (7) mounted on a fixed bracket (19) in conjunction with cog wheels and that said fixed bracket (19) together with said toothed drive belt (6), said cog wheels and said motor (7) is positioned outside the storage area for the copies and/or documents (8).

6. Copy and/or document removing apparatus in accordance with claim 4, characterized in that above the open top of said fixed section of said tray (3) there is a guide (18) running at right angles to the direction of movement of said sliding panel (5) which guides the copies and/or documents by one edge to a point directly above the storage area of said fixed section of said tray (3).

7. Copy and/or document removing apparatus in accordance with claim 6, characterized in that said guide (18) takes the form of a U-shaped guide channel (18*a*) running in the direction of conveyance of the copies and/or documents which guides the copies and/or documents by one edge to a position more or less parallel to said horizontal bottom panel (3*a*) of said fixed section of tray (3).

8. Copy and/or document removing apparatus in accordance with claim 6, characterized in that said guide (18) is adjustable in a direction parallel to the direction of movement of said sliding panel (5) in order to accommodate different copy/document formats.

9. Method for ejecting and removing copies and/or documents from a machine (1) by a catch and removal tray (2) which can be extended drawer fashion telescopically out of the machine and which has a fixed section (3) and a movable section (4), the copies and/or documents being stacked in the fixed section of the tray (3), said method comprising the following steps:

A. the movable section (4) of the catch and removal tray (2) is drawn out of the machine (1) to the extended position before commencement of the document stacking process:

A.1 the copies and/or documents are stacked in the tray until they reach a maximum stack height detected by a sensing device (20);

A.2 when the stack reaches the maximum height, the copies and/or documents are automatically pushed by a sliding panel (5) into the extended section of the tray (4) where they enter the detection range of a document sensor (21), the sliding panel (5) returning to its initial position; and A.3 more copies and/or documents are stacked in the rear section of the tray until the stack reaches the maximum height again, the new stack of copies and/or documents being automatically pushed out into the extended section of the tray (4) if the document sensor (21) for that section of the tray indicates that it is empty, and if the document sensor (21) detects that there is still a stack of documents (8) in the extended section of the tray (4), the sliding panel (5) is not set in motion until that stack has been removed; or B. the movable section (4) of the catch and removal tray (2) remains inside the machine (1) during the document stacking process;

B.1 the copies and/or documents are stacked in the tray until they reach a maximum stack height detected by a sensor (20) at which point the stacking process is paused; and B.2 The movable section of the tray (4) is drawn out of the machine, and when drawn out to its fully extended position, the movable section of the tray actuates a switch which activates the sliding panel which then pushes the stack of copies and/or documents into the extended section of the tray (4).

10. Method for ejecting and removing copies and/or documents from a machine (1) by a catch and removal tray (2) which can be extended drawer fashion telescopically out of the machine and which has a fixed section (3) and a movable section (4), the copies and/or documents being stacked in the fixed section of the tray (3), said method comprising the following steps:

A. the movable section (4) of the catch and removal tray (2) is drawn out of the machine (1) to an extended position dependent on the copy/document format being used before commencement of the document stacking process:

A.1 the copies and/or documents are stacked in the tray until they reach a maximum stack height detected by a sensing device (20);

A.2 When the stack reaches the maximum height, the copies and/or documents are automatically pushed by a sliding panel (5) into the extended section of the tray (4) and the sliding panel (5) returns to its initial position;

A.3 More copies and/or documents are stacked in the rear section of the tray until the stack reaches the maximum height again and the new stack of copies and/or documents is then automatically pushed out into the extended section of the tray (4), the stack of documents (8) already in the extended section of the tray (4) being pushed out of the open end of the extended section of the tray (4) by the next stack of documents and the sliding panel (5) returning to its initial position; and A.4 the stack of copies and/or documents pushed out of the extended section of the tray (4) passes onto a conveyor belt or falls directly into a larger container.

11. Method for ejecting and removing copies and/or documents in accordance with claim 10, characterized in that an additional step involves optional actuation of a removal button linked to a control unit whereby and incomplete stack of copies and/or documents can be pushed into the extended section of the tray (4) by the sliding panel (5) and the ejection process takes place within a time window calculated by the control unit during which no document will be deposited in the catch tray.

* * * * *